United States Patent [19]

McCullough, Jr. et al.

[11] Patent Number: 4,950,533

[45] Date of Patent: Aug. 21, 1990

[54] FLAME RETARDING AND FIRE BLOCKING CARBONACEOUS FIBER STRUCTURES AND FABRICS

[75] Inventors: Francis P. McCullough, Jr., Lake Jackson; R. Vernon Snelgrove, Damon, both of Tex.; David M. Hall, Auburn, Ala.

[73] Assignee: The Dow Chemical Company, Midland, Mich.

[21] Appl. No.: 383,836

[22] Filed: Jul. 21, 1989

Related U.S. Application Data

[63] Continuation-in-part of Ser. No. 114,324, Jan. 28, 1987.

[51] Int. Cl.[5] ..... B32B 9/00; D02G 3/00

[52] U.S. Cl. ..... 428/292; 428/221; 428/222; 428/224; 428/293; 428/357; 428/362; 428/364; 428/367; 428/369; 428/371; 428/372; 428/373; 428/408

[58] Field of Search ..... 428/367, 408, 364, 372, 428/357, 373, 292, 293, 362, 369, 221, 222, 224, 371

[56] References Cited

U.S. PATENT DOCUMENTS

| | | | |
|---|---|---|---|
| 3,904,577 | 9/1975 | Buisson | 428/367 X |
| 4,444,574 | 4/1984 | Tradewell et al. | 428/367 X |
| 4,457,345 | 7/1984 | vonBlucher et al. | 57/252 X |
| 4,459,332 | 7/1984 | Giglia | 428/368 X |
| 4,460,650 | 7/1984 | Ogawa et al. | 428/389 |
| 4,565,727 | 1/1986 | Giglia et al. | 428/172 |
| 4,643,931 | 2/1987 | McCullough, Jr., et al. | 428/367 X |
| 4,698,956 | 10/1987 | Clarke et al. | 57/350 |

FOREIGN PATENT DOCUMENTS 8606110 10/1986 World Int. Prop. O. .

*Primary Examiner*—Lorraine T. Kendell

[57] ABSTRACT

Flame retarding and fire barrier structure comprising a blend of carbonaceous fibers and natural and/or synthetic polymeric fibers. The carbonaceous fibers are present in the blend in an amount of from 7.5 to 92.5 percent and have a carbon content of greater than 65 percent and a LOI value of greater than 40. The structure also contains carbonaceous particles or platelets.

10 Claims, No Drawings

FLAME RETARDING AND FIRE BLOCKING CARBONACEOUS FIBER STRUCTURES AND FABRICS

RELATED APPLICATION

This application is a continuation-in-part of application Ser. No. 114,324 filed Jan. 28, 1987 of Mc Cullough et al.

FIELD OF THE INVENTION

The present invention relates to flame retarding and fire blocking structures and fabrics comprising a blend of substantially permanently or irreversibly heat set, non-flammable, carbonaceous fibers with polymeric fibers, and a method for using such structures. The invention also provides for the use of carbonaceous platelets or particles alone or in combination with the fibers.

BACKGROUND OF THE INVENTION

The use of felts made from asbestos, carbon and graphite using short and straight staple fibers, as well as various ceramic materials, particularly ceramic foams, as thermal insulation having fire blocking properties is generally known. The bulk densities of some of the well known thermal insulating materials are in the range of from 5.6 to 32 kg/m$^3$ for insulating materials useful at temperatures of up to 1650 degrees Celsius. Even the newest "lightweight" insulating material comprising a ceramic from which a carbonaceous material has been burned out has a bulk density of from 32 to 96 kg/m$^3$. In addition, with the possible exception of fiberglass which may be used under certain conditions as a fire block, the commonly known thermal insulating materials having fire block properties, such as carbon or graphite felts and ceramic materials, do not have any resiliency, i.e., they do not have the ability to recover from compression (spring back) of the original "loft". Further, these prior art materials are not compressible from their original loft to any great degree since such fibers have little memory.

Both government and industry have conducted extensive research into developing structures or fabrics that would either be nonflammable or at least retard the propagation of a fire. In conjunction with finding an effective material to act as a fire barrier, consumer considerations require that any such materials to be functional, aesthetically acceptable and reasonably priced.

Unfortunately, past efforts to develop a suitable fire barrier have not been very effective. Thus, even fabrics that will not ignite from, for example, a smoldering cigarette and that are considered to be a class 1 fabrics under the UFAC upholstery fabric classification test, will burn when placed in contact with an open flame. Consequently, this leads to the ignition of an underlying material, such as a cushion or mattress.

So called fire retardant foam coatings for draperies, liners and backcoatings for upholstery, as well as chemical treatments for apparel fabrics, that attempt to provide a fire retardant quality to the fabric are commercially available. Unfortunately, these materials are, at best, self extinguishing only when the source of the flame is removed. If the flame source is not removed, these materials will char, lose their integrity and, most importantly, will not prevent the flame from reaching materials underneath the fabric covering which act as a major source of fuel for the fire.

Other attempts at solving the flammability problem have centered on the use of inherently non-flammable fabrics such as fiberglass which can be used, for example, in draperies. It has been discovered, however, that the glass fibers are self-abrasive in that they rub against each other thereby becoming self-destructing due to such abrasive action. Thus, to reduce abrasive action, hand washing and line drying is, out of necessity, the recommended cleaning procedure for such fabrics. Moreover, the relatively brittle glass fibers tend to break and become very irritating to the skin thus rendering any of the applications of the fabric unsuitable where there is extensive skin contact. Fiberglass fabrics usually also contain flammable sizing binders and/or finishes to provide an aesthetic appearance.

Consequently, there is a need for structures such as fabrics, battings, webs, and the like, which not only provide fire shielding properties, but also are washable, lightweight and can be fabricated into aesthetically acceptable fabrics for home and commercial use.

U.S. Pat. No. 4,588,635 to James C. Donovan discloses a lightweight thermal insulation material which is a blend of spun and drawn, crimped, staple, synthetic polymeric fibers having a diameter of from 3 to 12 microns, and synthetic polymeric staple fibers having a diameter of greater than 12 and up to 50 microns. However, the insulation material is flammable.

U.S. Pat. No. 4,167,604 to William E. Aldrich discloses the use of the crimped hollow polyester filaments in a blend with fowl down (e.g., duck or goose down) in the form of a multiple ply carded web which is treated with a thermosetting resin to form a batting having thermal insulating characteristics. The web, however, does not have fire retarding characteristics.

U.S. Pat. No. 4,321,154 to Francois Ledru relates to a high temperature thermal insulating material comprising insulating material fibers and pyrolytic carbon. To make the insulation lightweight, an expanding agent is utilized that is composed of hollow particles such as microspheres.

European Patent Application Serial No. 0199567, published Oct. 29, 1986, to F. P. Mc Cullough, et al entitled, "Carbonaceous Fibers with Spring-Like Reversible Deflection and Method of Manufacture", discloses non-flammable, carbonaceous fibers that are suitably employed in the structures and fabrics of the present invention.

The carbonaceous fibers, particles or platelets have a carbon content of at least 65% and a LOI value greater than 40, as determined by test method ASTM D 2863-77. The test method is also known as "oxygen index" or "limited oxygen index" (LOI). With this procedure the concentration of oxygen in $O_2/N_2$ mixtures is determined at which a vertically mounted specimen is ignited at its upper end and just continues to burn. The size of the specimen is 0.65×0.3 cm with a length of from 7 to 15 cm. The LOI value is calculated according to the equation:

$$LOI = \frac{[O_2]}{[O_2 + N_2]} \times 100$$

The LOI values of different natural and synthetic fibers are as follows:

| | |
|---|---|
| Polypropylene | 17.4 |
| Polyethylene | 17.4 |
| Polystyrene | 18.1 |
| Rayon | 18.6 |
| Cotton | 20.1 |
| Nylon | 20.0 |
| Polycarbonate | 22.0 |
| Rigid polyvinyl chloride | 40.0 |
| Stabilized polyacrylonitrile | >40 |
| Graphite | 55.0 |

The term "stabilized" herein applies to carbonaceous precursor fibers which have been oxidized at a specific temperature, typically less than about 250 degrees Celsius for acrylic fibers. It will be understood that in some instances the fibers are oxidized by chemical oxidants at lower temperatures.

The term "polymeric fibers" used herein includes natural fibers as well as other organic polymeric fibers.

The term "permanent" or "irreversibly heat set" used herein when applied to a linear carbonaceous fiber refers to the fiber being heat treated until it possesses a degree of chemical irreversibility.

All percentages hereinafter referred to are in percent by weight.

SUMMARY OF THE INVENTION

Generally, in accordance with the present invention there is provided a fire retarding and fire blocking structure comprising a blend of fibers selected from polymeric fibers and nonflammable, irreversibly heat set, carbonaceous fibers having an LOI value of greater than 40, wherein said carbonaceous fibers are present in the blend in an amount greater than 7.5 percent, with the proviso that there are present at least 0.5% by weight of carbonaceous particles and/or platelets.

In accordance with another feature of the invention, carbonaceous particles and/or platelets may be utilized in lieu of fibers. The particles are especially useful in non-woven fabrics. It has been found to be advantageous to place the particles or platelets on the surface to provide a flame barrier. Preferably, the structure of the invention contains 0.5 to 20% particles and/or platelet. Small amounts may be used when the particles and/or platelets are placed on the surface of the structure.

Advantageously, the carbonaceous materials are derived from stabilized polymeric fibers or pitch based fibers. The linear carbonaceous fibers may be combined with non-linear fibers. The nonlinear fibers have been found to provide considerable loft and improved thermal insulating properties to structures and/or fabrics utilizing them. The nonlinear fibers also provide a porosity which inhibits the spread of fire.

It has also been discovered that the carbonaceous fibers, when intimately blended with non-carbonaceous polymeric fibers to form a structure, such as a tow, yarn, web, wool-like fluff, batting, fabric, or the like, results in a synergistic effect with respect to fire blocking and fire retarding properties to the blend. It is understood that when the structure is densified (i.e., compressed to form a structure having a higher density as compared to an uncompressed structure) for a particular use, it is preferable to use a higher amount of carbonaceous fibers and/or particles or platelets.

The invention further contemplates a method for providing flame retarding and fire shielding structures with respect to a structural part or a pair of adjacent structural parts.

It is therefore an object of the invention to provide a carbonaceous fibrous structure which is both fire retarding and provides a fire barrier.

It is another object of the invention to provide a fire shielding structure comprising an intimate blend of carbonaceous materials with other polymeric fibers which possess good handling and washing characteristics.

It is yet another object of the invention to provide a method for forming a fire shield for a structural part or a pair of adjacent structural parts.

It is still a further object of the invention to provide a woven or non-woven fabric or a clothing article which is aesthetically acceptable and possesses fire blocking characteristics.

Both linear and nonlinear carbonaceous fibers can be utilized in the present invention. When nonlinear fibers are included, the loft and the shape reforming characteristics of the wool like structure, fabric or batting, which contains the blend of fibers, is maintained even after long periods of compression. It is understood that the greater the amount of nonlinear carbonaceous fibers which are utilized, the greater will be the shape reforming and fire retarding characteristics of the structure. An amount of up to 92.5 percent nonlinear carbonaceous fibers may be utilized in the blend. Additional benefits are not derived from employing higher amounts. Preferably, the carbonaceous fibers are present in the blend in an amount of from 7.5 to 80 percent, more preferably from 10 to 60 percent. When only linear carbonaceous fibers are being utilized, they are present in the blend in an amount of at least about 15 percent. When lower amounts of linear carbonaceous fibers are utilized, particles or platelets of carbonaceous material may be used to maintain good fire blocking characteristics.

Carbonaceous particles or platelets may be incorporated into the structure as to reduce the fiber requirement. It has been found that as little as about 0.5 percent of particles or platelets on the surface of a structure improves the structure with fire resistance and provides a flame barrier.

The polymeric fibers may also be linear or nonlinear. However, the nonlinear carbonaceous fibers are irreversibly heat set, resilient, and shape retaining so that the structure permanently maintains a degree of loft and porosity to provide good hand even when the other fibers lose their nonlinearity.

The nonlinear carbonaceous fibers which are utilized may have a sinusoidal and/or a coil-like configuration depending upon the ultimate use of the fibers. Fibers, particles or platelets that are derived from an acrylic based polymer and have a nitrogen content of from 10 to 20 percent, preferably from 16 to 20 percent provide the best fire resistance to the blended structure.

In accordance with one embodiment of the invention, the carbonaceous fibers are opened and then blended with polymeric fibers, i.e., either synthetic or natural fibers or both, to form a fiber mixture or blend.

The blend of carbonaceous fibers and other polymeric fibers may be formed into a carded web employing conventional carding equipment which is well known to persons skilled in the art. The carding operation serves to uniformly blend the carbonaceous fibers and other staple fibers. The carded web will ordinarily have a thickness in the range of up to about 5 cm, but may built up in multiple plies to produce a web having a thickness of 25 cm or more depending upon the desired end use of the material.

The blend of fibers and or particles and platelets may be utilized in order to form fabrics having fire retarding characteristics. For example, a blend of fibers which contains from 7.5 to 20 percent of the carbonaceous materials of the invention may be utilized to manufacture fire retardant articles such as clothing, blankets, sheets and the like. Such fabric articles have excellent washability and shape retaining quality especially when a large proportion of nonlinear carbonaceous fibers are employed. Carbonaceous materials in which the nitrogen content is from 16 to 20 percent are especially useful for fabrics making skin contact with the wearer.

Fabric structures which contain the carbonaceous materials of the invention in amounts of from 20 to 40 percent may advantageously be used for seat coverings in upholstery, battings in seat covers, curtains and the like. Providing carbonaceous particles or platelets near the surface provides a flame barrier.

Use of carbonaceous materials in the blends in amounts of up to 92.5 percent improve the fire blocking and fire shielding characteristics of the structures. The structures having greater amounts of carbonaceous materials also have greater chemical resistance. The structures may be used as filters, hose coverings, static precipitators and the like. However, it is desirable to maintain a fabric characteristic close to conventional structures so as to have an aesthetic appearance and feel.

The fabrics may comprise a blend of all natural fibers, all synthetic polymeric fibers, or a combination of both together with the carbonaceous fibers and particles or platelets.

Non-woven, non-flammable fabrics may be made by conventional methods of utilizing a blend of fibers with a suitable binder such as polyester, polypropylene or the like, and subjecting the mixture to heat and pressure. Advantageously, carbonaceous particles or platelets are placed on the surface.

The natural fibers, wherein the synergistic effect is found when used in a blend with the carbonaceous fibers, include cotton, wool, flax, silk, and mixtures thereof.

The synthetic polymeric fibers which can be utilized to form a blend with the carbonaceous fibers include, for example, polyolefins, such as polyethylene, polypropylene, and the like, polyvinyl chloride, polyvinyl alcohol, polyesters, polyacrylonitrile, polyacrylates, polycarbonate, cellulosic products, ionomers, DACRON and KEVLAR (both trademarks of E.I. de Pont de Nemours & Co., Inc.), and the like. It is to be understood, of course, that a blend of natural and/or synthetic polymeric fibers with the carbonaceous materials may be used.

The precursor stabilized acrylic fibers which are advantageously utilized in preparing the carbonaceous fibers, particles or platelets are selected from acrylonitrile homopolymers, acrylonitrile copolymers and acrylonitrile terpolymers.

The copolymers and terpolymers preferably contain at least about 85 mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridene, and the like.

Preferred precursor materials are prepared by melt spinning or wet spinning the precursor materials in a known manner to yield a monofilament or multifiliment tow. The fibers are formed into a manufactured structure such as a yarn, woven fabric or knitted cloth, and the like, by any of a number of commercially available techniques. The structure is then heated, preferably to a temperature above about 525 degrees Celsius in a non-oxidizing atmosphere, and thereafter deknitted or disassembled and carded to produce a wool-like fluff which may be laid up in batting-like form.

A first group of carbonaceous materials that are thus produced can be classified as being electrically nonconductive and to possess no antistatic characteristics, i.e., they do not have the ability to dissipate an electrostatic charge.

The term electrically nonconductive as utilized in the present invention relates to fibers having a resistance of greater than $4 \times 10^6$ ohms/cm when measured on a 6K tow (6000 filaments) formed from precursor fibers having a diameter of from 4 to 25 microns. The specific resistivity of the carbonaceous fibers is greater than $10^{-1}$ ohm-cm. The specific resistivity is calculated from measurement described in European Patent Application No. 0199567.

When the precursor fiber is an acrylic fiber it has been found that a nitrogen content of 20 percent or more results in a nonconductive fiber.

In a second group, the carbonaceous materials are classified as being partially electrically conductive (i.e., having low conductivity) and having a carbon content of less than 85 percent. Low conductivity means that a 6K tow of fibers has a resistance of from $4 \times 10^6$ to $4 \times 10^3$ ohms/cm. Correspondingly, the electrical resistivity of the fibers as less than $10^{-1}$ ohm-cm. Preferably, the carbonaceous materials are derived from stabilized acrylic fibers and possesses a percentage from about 16 to 20 percent. The structures formed therefrom are lightweight, have low moisture absorbency, good abrasive strength together with good appearance and handle.

In a third group is the carbonaceous materials having a carbon content of at least 85 percent. These materials are characterized as being highly electrically conductive. That is, the resistance is less than $4 \times 10^3$ ohms/cm and the materials are useful in applications where electrically grounding or shielding are also desired.

The carbonaceous fibers and/or particles or platelets used for their fire blocking characteristics preferably have a nitrogen content of about 5 to 35%.

Amongst the other precursor materials which may be utilized in preparing the fibers, particles or platelets of the invention are included stabilized polyaramids, polybenzimidzole, polyvinyl chloride, pitch and the like.

The particles or platelets of the invention can be prepared by grinding carbonaceous fibers or foams.

Exemplary of the structures of the present invention are those set forth in the following examples.

EXAMPLE 1

A. Battings were made by blending an appropriate percentage of each respective opened fiber in a blender/feed section of a sample size 30 cm Rando Webber Model B (manufactured by Rando Machine Corp. of Macedon, N.Y.). The battings thus produced typically were about 2.5 cm thick and had a bulk density in the range of from 6.4 to 96 kg/m$^3$. The battings were thermally bonded by passing it on a conveyor belt through a thermal bonding oven at a temperature of about 300 degrees Celsius.

Flammability tests were run in a standard testing apparatus as cited in FTM 5903 according to the procedure of FAR 25.8536 9 which references FTM 59030.

EXAMPLE 2

Following the procedure of Example 1, similar tests were performed and the results are shown in the following Table II:

TABLE II

| Sample No. | Sample Composition | Composition | Densification Method | Burn Length (cm) | After Flame (sec) | Pass or Fail |
|---|---|---|---|---|---|---|
| 1 | NLCF/PEB/PE | 30/20/51 | NP | 3.75/3.75/2.5 | 0/0/0/ | Passed |
| 2 | NLCF/PEB/PE | 30/20/50 | PS | 1.25/1.87/1.25 | 0/0/0/ | Passed |
| 3 | NOMEX/PEB/PE | 20/20/60 | NP | Total | 30 | Failed |
| 4 | NOMEX/PEB/PE | 50/20/30 | NP | Total | 40 | Failed |
| 5 | NLCF/PEB/PE | 20/20/60 | NP | 5/5/5 | 0/0/0/ | Passed |
| 6 | NLCF/PEB/PE | 20/20/60 | PS | 3.75/3.75/3.75 | 0/0/0/ | Passed |
| 7 | NLCF/PEB/Cotton | 30/15/55 | NP | 2.5/2.5/2.5 | 0/0/0 | Passed |
| 8 | NLCF/PEB/Cotton | 30/5/55 | — | 1.25/1.25/1.25 | 0/0/0/ | Passed |
| 9 | NLCF/PEB/Cotton | 30/15/55 | NP | 1.87/1.87/1.87 | 0/0/0/ | Passed |
| 10 | NLCF/PEB/Cotton | 30/15/55 | PS | 3.1/3.75/3.1 | 0/0/0/ | Passed |
| 11 | KEVLAR/PEB/PE | 50/20/30 | — | 1.25/1.25/1.25 | 0/0/0/ | Failed |
| 12 | KEVLAR/PEB/PE | 50/20/30 | NP | 8.75/7.5/8.75 | 0/0/0/ | Failed |
| 13 | KEVLAR/PEB/PE | 50/20/30 | PS | 3.1/3.75/3.75 | 0/0/0/ | Passed |
| 14 | KEVLAR/PEB/PE | 20/20/60 | — | >30 | complete | Failed |
| 15 | KEVLAR/PEB/PE | 50/15/30 | — | 37.5/1.25/1.25 | 0/0/0/ | Passed |
| 16 | KEVLAR/PEB/PE | 50/15/30 | NP | 1.25/1.25/1.25 | 0/0/0/ | Passed |
| 17 | KEVLAR/PEB/PE | 50/15/30 | PS | 1.87/1.87/1.87 | 0/0/0/ | Passed |

NP = needle punched at 100 punches/in$^2$ (15.5 punches per cm$^2$)
PA = Pin Sonic Thermally Bonded in diamond pattern
NOMEX and KEVLAR are both trademarks of E. I. du Pont de Nemours & Co., Inc.

The results are shown in the following Table I:

TABLE I

| Sample No. | Sample Composition | % Wt. | Burn Length | After Flame (Sec). | Pass or Fail |
|---|---|---|---|---|---|
| 1 | NLCF/PEB/PE | 10/20/70 | 5/7.5/2.5 | 0/0/0/ | Passed |
| 2 | NLCF/PEB/PE | 20/20/60 | 1.87/1.81/1.87 | 0/0/0/ | Passed |
| 3 | NLCF/PEB/PE | 25/20/55 | 1.87/1.81/1.87 | 0/0/0/ | Passed |
| 4 | NLCF/PEB/PE | 30/20/50 | 1.25/1.25/1.25 | 0/0/0/ | Passed |
| 5 | NLCF/PEB/PE | 40/20/40 | <1.25/<1.25/0 | 0/0/0/ | Passed |
| 6 | NLCF/PEB/PE | 5/20/75 | complete | >20 sec. | Failed |
| 7 | NLCF/PEB/PE | 50/20/30 | 0/0/0 | 0/0/0/ | Passed |
| 8 | OPF/PEB/PE | 10/20/70 | complete | >20 sec. | Failed |
| 9 | LCF/PEB/PE | 50/20/30 | <.6/<.6/<.6 | 0/0/0/ | Passed |
| 10 | NLCF/PEB/Cotton | 10/10/80 | 1.25/.6/1.25 | 0/0/0/ | Passed |
| 11 | NOMEX/PEB/PE | 20/20/60 | complete | >38 sec. | Failed |
| 12 | NOMEX/PEB/PE | 50/20/30 | complete | >30 sec. | Failed |
| 13 | NLCF/PEB/Cotton | 10/15/75 | 1.85/1.85/1.25 | 0/0/0/ | Passed |
| 14 | NLCF/PEB/Cotton | 5/15/80 | >30 | >14 | Failed |
| 15 | NLCF/PEB/PE | 5/20/75 | >30 | >195 | Failed |
| 16 | NLCF/PEB/PE | 7.5/20/72.5 | 5/25/5 | 0/7/0 | Borderline |
| 17 | LCF/PEB/Cotton | 25/15/60 | 2.5/3.1/2.5 | 0/0/0/ | Passed |
| 18 | OPF/PEB/Cotton | 50/15/35 | >35 | 3 sec. | Failed |
| 19 | NLCF/PEB/Cotton | 20/15/65 | | | Passed |
| 20 | NLCF/PEB/Wool | 5/15/80 | | | Failed |
| 21 | NLCF/PEB/Wool | 10/15/75 | | | Passed |
| 22 | NLCF(sc)/PEB/Cotton | 20/15/65 | | | Passed |
| 23 | OPF/PEB/PE | 50/20/30 | | | Failed |

NLCF = nonlinear carbonaceous fiber
LCF = linear carbonaceous fiber
LCF (SC) = liner carbonaceous fiber with small amplitude crimp
PEB = 8 denier polyester binder fiber of 410 KODEL (a trademark of Eastman Chem. Prod. Inc.)
PP = polypropylene
PE = 6 denier 5 cm staple Dupont DACRON 164 (a trademark of du Pont)
Cotton = nontreated 3.75 cm cotton
OPF = stabilized polyacrylonitrile fiber
NOMEX = a trademark of E. I. du Pont de Nemours & Co., Inc. for an aramid fiber The addition of particles and platelets may be used to improve the fire resistant characteristics of the fabric and could substantially improve those which have failed the test.

The foregoing table shows surprisingly that use of as little as 7.5 percent by weight of nonlinear carbonaceous fibers in the blends resulted in substantially no after flame when the flame source was removed, and there were no flame drippings.

EXAMPLE 3

Nonflammability Test

The nonflammability of the fabric of the invention was determined following the test procedure set forth in 14 CFR 25.853(b). The test was performed as follows:

A minimum of three 2.5 cm×15 cm×30 cm specimens comprised of 10 percent carbonaceous fiber, 10 percent polyethylene and 80 percent cotton, were conditioned by maintaining the specimens in a conditioning room maintained at temperature of 21 degrees Celsius 5 degrees Celsius and 50 percent 5 percent relative humidity for 24 hours preceding the test.

Each specimen was supported vertically and exposed to a Bunsen or Turill burner with a nominal I.D. tube adjusted to give a flame of 3.8 cm in height. The minimum flame temperature measured by a calibrated thermocouple pyrometer in the center of the flame was 843 degrees Celsius. The lower edge of the specimen was 1.9 cm above the top edge of the burner. The flame was applied to the center line of the lower edge of the specimens for 12 seconds and then removed.

Pursuant to the test, the material was self-extinguishing. The average burn length did not exceed 20 cm. The average after flame did not exceed 15 seconds, and there was no flame drippings.

Similar results may be achieved if the carbonaceous fiber is either derived from an acrylic precursor or a pitch based fiber.

Having described the invention in detail and by reference to the preferred embodiments thereof, it will be apparent that the modifications and variations, such as may be readily apparent to persons skilled in the art, are intended to be included within the scope of the invention as herein defined in the appended claims.

EXAMPLE 4

Following the procedure of Example 1, a batting was prepared of a blend of 10 percent carbonaceous fibers, 40 percent cotton and 40 percent Kodel 410 polyester. The mixture was placed on a compression platen and heated to 260 degrees Fahrenheit with a compression of 25 lbs./in$^2$. While the polyester was in a softened state, 10 percent by weight of carbonaceous particles were distributed on the upper surface of the compressed web. The web was again subjected to heat and compression so that a non-woven fabric was formed with carbonaceous particles forming a flame barrier on the surface.

What is claimed is:

1. A fire retarding and fire blocking fabric structure comprising: (a) an intimate blend of polymeric fibers selected from the group consisting of natural and synthetic fibers, and nonflammable, substantially irreversibly heat set, non-graphitic carbonaceous fibers having a carbon content greater that 65% and an LOI value of greater than 40, wherein said carbonaceous fibers are present in said blend in an amount greater than 7.5 percent by weight and (b) 0.5 to 20 percent by weight of materials selected from the group consisting of non-graphitic carbonaceous particles and platelets having a carbon content greater than 65%.

2. The structure of claim 1, wherein said carbonaceous fibers comprise at least 15 percent of said blend and wherein said carbonaceous particles are present as a coating on the surface of said structure.

3. The structure of claim 1, wherein said carbonaceous fibers are nonlinear, resilient, shape reforming and elongatable, and have a reversible deflection ratio of greater than 1.2:1 and an aspect ratio of greater than 10:1.

4. The structure of claim 1, wherein said carbonaceous fibers are derived from stabilized polymeric precurser fibers or pitch based fibers.

5. The structure of claim 1, comprising carbonaceous fibers and particles have a carbon content of at least 85 percent, are electrically conductive and have an electrical resistance of less than $4\times10^3$ ohms/cm.

6. The structure of claim 1, wherein said carbonaceous fibers and particles have a carbon content of less than 85 percent, and wherein said fibers are electrically nonconductive or do not possess any electrostatic dissipating characteristics, and have an electrical resistance of greater than $4\times10^3$ ohms/cm.

7. The structure of claim 1, wherein said carbonaceous fibers and particles have a carbon content of less than 85 percent, have a low electrical conductivity and electrostatic dissipating characteristics, and have an electrical resistance of from $4\times10^6$ to $4\times10^3$ ohms/cm.

8. The structure of claim 1, wherein said polymeric fibers are natural fibers selected from cotton, wool, flax, silk and mixtures thereof, or synthetic fibers selected from cellulose, polyester, polyolefin, aramid, polyacrylic, fluoroplastic, polyamide, polyvinyl alcohol and mixtures thereof.

9. The structure of claim 1, which is a non-woven fabric.

10. A fire retarding and fire blocking fabric structure comprising: (a) an initimate blend of fibers selected from the group consisting of natural and synthetic fibers and (b) a fire retarding effective amount of a material selected from the group consisting of non-graphitic carbonaceous particles and platelets having an LOI greater than 40 and a carbon content of greater than 65%.

* * * * *